United States Patent [19]

Salzmann

[11] Patent Number: 4,528,802

[45] Date of Patent: Jul. 16, 1985

[54] FOOD WRAP SEALER

[75] Inventor: Ferdinand F. Salzmann, Prairie du Sac, Wis.

[73] Assignee: Wisco Industries, Inc., Oregon, Wis.

[21] Appl. No.: 421,726

[22] Filed: Sep. 22, 1982

[51] Int. Cl.[3] ..... B65B 53/02

[52] U.S. Cl. ..... 53/557; 53/390; 53/580

[58] Field of Search ..... 53/442, 463, 557, 390, 53/580; 219/342, 367, 460

[56] References Cited

U.S. PATENT DOCUMENTS 3,060,655 10/1962 Dreyfus ..... 53/442
3,214,882 11/1965 Emus ..... 53/557
3,389,478 6/1968 Cline ..... 53/557 X
3,427,789 2/1969 Emus ..... 53/442

*Primary Examiner*—John Sipos
*Attorney, Agent, or Firm*—Isaksen, Lathrop, Esch, Hart & Clark

[57] ABSTRACT

A food sealing device for shrink-wrapping foods such as pizza includes a heat source surrounded by an inner shroud to create an updraft for heating the film. A second outer shroud is positioned around the inner shroud to prevent the film from contacting the hot inner shroud to prevent melting of the film against the inner shroud which might otherwise damage the film or the food item.

3 Claims, 3 Drawing Figures

FOOD WRAP SEALER

TECHNICAL FIELD

The present invention relates to wrapping devices for wrapping and packaging foods for the consumer in general, and relates, in particular, to shrink wrapping sealing devices for shrink wrapping plastic film over large flat foods, such as pizza.

DESCRIPTION OF THE PRIOR ART

The prior art is generally cognizant of a shrink wrap pizza sealer which includes a small elevated platform over a single tubular cylindrical shroud of metal. A heating coil is located inside of the single shroud of material and is electrically heated so as to create an upward convection current inside of the single shroud of material rising toward the elevated platform. The user of such a sealing device places the pizza or other food item on the elevated platform and then places a large piece of shrink wrap film over the pizza and draped over the sides thereof. The air inside of the shroud is heated by the electrical current thereby causing an updraft to occur and the heated air rising in the updraft heats the packaging film so as to therefore cause it to shrink. The shrink wrapping film then shrinks until a tight wrap around the pizza is achieved. Since the film shrinks toward the periphery of the pizza, the small elevated stand on which the pizza has been placed is not covered by the shroud and the pizza may be freely lifted off of the sealing device.

Such prior art pizza packaging sealing devices generally work satisfactorily. There is, however, one troublesome problem which occurs with some regularity with the use of such devices. Since the cylindrical shroud which surrounds the heating coil becomes warmed by the updraft of warm air passing therethrough, the shroud can become very hot to the touch. This alone can offer some element of danger or inconvenience to the user of the system since it can cause pain or burns. In addition, as the shrink wrapping film, after being placed over the pizza, contracts, a portion of the shrink wrapping film can on occasion contact the heated shroud and adhere to it because of the high temperature of the shroud. If such a portion of the shrink film does adhere to the shroud, the film continues to shrink and thus the entire film, and the pizza there with it, is pulled toward the portion of the film stuck to the shroud to thereby drag the pizza off of the elevated platform causing it to collapse into the interior of the sealer thereby destroying the pizza. The present invention is intended to prevent this failure mode so as to insure reliable operation of a food sealer for pizzas of this type.

SUMMARY OF THE INVENTION

The present invention is summarized in that a sealing device for sealing shrink-wrapping packaging film over a flat food item such as pizza includes: an elevated support disc upon which the food may be placed; a heat source placed underneath the elevated platform, an inner cylindrical shroud placed around the heating coils so as to cause a warm updraft of air to be directed toward the elevated stand to shrink packaging film placed over the food on the stand; and an outer protective shroud of cylindrical shape positioned around the inner shroud so as to protect the first shroud from contact with the packaging film.

It is an object of the present invention to provide a device for the packaging of pizza or other flat food items with a shrink wrap wherein the possibility of contact of the shrink wrap film to a heated surface is prevented.

It is another object of the present invention to provide a sealing device for shrink wrapping packaging film over pizzas or similar food items which is safer and more reliable in its operation than previously known devices.

It is a further object of the present invention to achieve such objectives as economically efficiently as possible and without the need for moving parts.

Other objects, advantages and features of the present invention will become apparent from the following specification when taken in conjunction with the accompanying drawings.

DESCRIPTION OF THE PREFERRED EMBODIMENT

Figure 1:
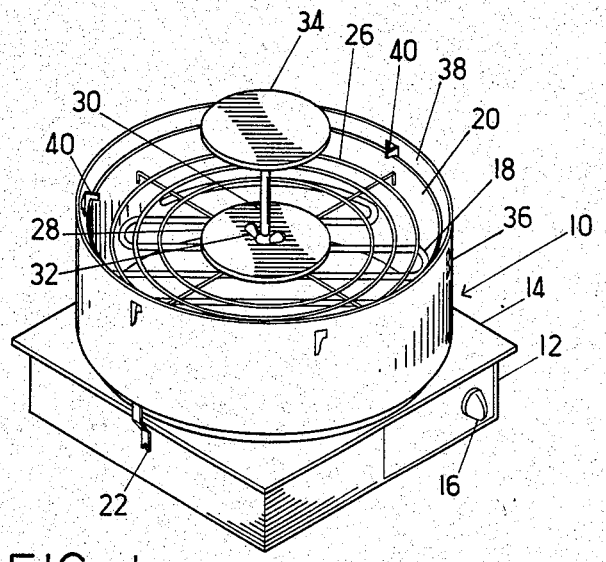
FIG. 1 is a perspective view of a packaging sealer constructed in accordance with the present invention.

Shown in FIG. 1, and generally illustrated at 10, is a sealing device constructed in accordance with the present invention. The sealing device 10 is a self-contained unit containing no moving parts which is effective to shrink wrap packaging films over pizzas or other similar food items.

The sealing device 10 is largely mounted upon a unit base 12 which is in the shape of a rectangular block in the unit shown in FIG., 1 but which can be of any other similar or arbitrary shape suitable for supporting the remaining components of the device. A base plate 14 is placed atop the base unit 12 to support the remaining components of the device and to prevent food contamination of the interior portions of the control placed inside of the base unit 12. A heating control 16 is provided with suitable components located in the interior of the base unit 12 to control the operation and intensity of a heat source 18. The heat source 18 is located on top, and in the general center of, the base plate 14 and is controlled by the control 16. Preferably, the heat source 18 is an electric resistance heating coil formed into either a coil or serpertine shape and arranged in a plane located just above and parallel to the plane of the base plate 14.

Surrounding the heat source 18 is an inner shroud 20. The inner shroud 20 is a cylindrical tubular portion of metallic material having a diameter sufficiently large so as to entirely encompass and surround the heat source 18 and extending generally upward along an axis perpendicular to the plane of the base plate 14. The inner shroud 20 is supported in a raised orientation above the base plate 14 by a plurality of four shroud brackets 22, as may be seen more clearly by referring to FIGS. 2 and 3. In this fashion, an air space 24 is created between the bottom of the inner shroud 20 and the top of the base plate 14 through which air may freely pass. Attached near the top of the inner wall of the inner shroud 20 is a grill 26 formed of any arbitrary shape and sufficiently covering the open top of the inner shroud 20 such that a user's hand or other large object cannot penetrate into the interior of the inner shroud 20 so as to contact the heat source 18. A lower support disc 28 is formed in the interior of and attached to the grill 26 and has a central aperature formed therein so as to receive a shaft 30. The shaft 30 extends through the lower disc 28, with the length of extension of the shaft 30 through the lower disc 28 being adjustably controlled by a wing nut 32. At the top of the shaft 30, an upper food support disc 34 is provided which is the same size as, and is parallel to, the lower disc 28. The food support disc 34 is sized so as to be capable of receiving and supporting a flat food item, such as a pizza, thereon while remaining small enough so that the wrapped food item can be freely removed from the device without wrapping the food support disc 34 in with the food.

Mounted around and outside of the inner shroud 20 is a protective outer shroud 36. The outer shroud 36 has a slightly larger diameter than the inner shroud 20 and is similar in vertical dimension although it may optionally be larger than the inner shroud 20 in vertical size. The outer shroud 36 is placed around the inner shroud 20 so that an axial, annular, and cylindrically extended air corridor 38 is defined between the inner shroud 20 and the outer shroud 36. A plurality of indented support tabs 40 are formed in the outer shroud 36 and consist of inwardly bent cut out portions of the outer shroud 36 which are shaped and sized so as to rest upon the upper peripheral edge of the inner shroud 20 and so as to hold the outer shroud 36 in position resting upon the inner shroud 20. The location of the support tabs 40 is selected so that the outer shroud 36 rests slightly above, at its upper edge, the upper edge of the inner shroud 20 with the result that the bottom of the lower shroud 20 extends below the bottom of the outer shroud 36, as can be viewed in FIGS. 2 and 3.

Figure 2:
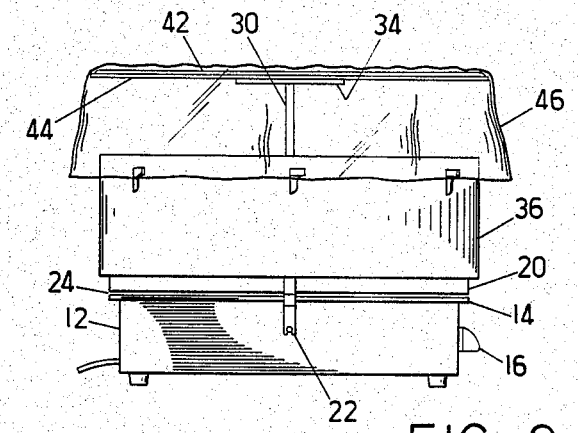
FIG. 2 is a side elevational view of the package sealer of FIG. 1 showing an intermediate step in the sealing operation using such device.
Figure 3:
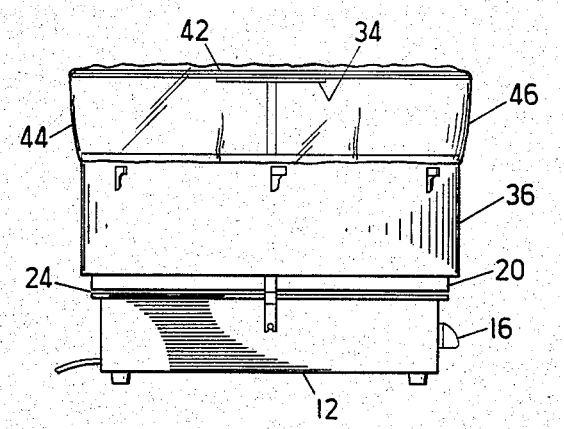
FIG. 3 is a side elevational view similar to FIG. 2 showing a later intermediate step in the use of that device.

In its operation, the sealing device 10 of FIGS. 1 through 3 functions to efficiently, cheaply, and quickly seal a film of shrink wrap thermoplastic material over a flat food item such as a pizza. The operation is done with no moving parts and with a minimum possibility of any contamination of either the food or the apparatus by the plastic film. In using the sealing device 10 of FIGS. 1 through 3, the first step is to place the food, such as the pizza, upon the food support disc 34, as can be seen in FIG. 2. In FIGS. 2 and 3, the food item indicated is a pizza, generally indicated at 42 which is resting upon a cardboard support plate indicated at 44. The pizza and support plate 44 are located upon the food support disc 34 in such a fashion that they are stabily balanced thereon. Then a large piece of shrink wrap film, indicated at 46, is draped over the pizza 42 and the support plate 44 and allowed to drape down hanging outside of the outer shroud 36 as can be viewed in FIG. 2.

Prior to placing the pizza 42 on the sealing device, the heat source 18 can be previously energized so as to be hot and ready to use. Alternatively, after the shrink wrap film 46 is placed over the pizza as shown in FIG. 2, the heating unit 18 can then be energized by the control 16. When the heat source 18 is energized, it heats the air adjacent to the heating unit itself which air, having become heated, then tends to rise. This causes an updraft of heated air to be constantly issuing forth from the interior of the inner shroud 20. This updraft of air is fed by air entering the air gap 24 at the bottom of the inner shroud 20. This updraft of heated air contacts the shrink wrap film 46 and heats it causing it to shrink. The shrink wrap film 46 then begins to contract both around the pizza 42 and contracting around its periphery around the top of the inner shroud 36 as shown in FIG. 3. Since the outer shroud 36 is spaced from the inner shroud 20 by the air gap 38, the outer shroud 36 stays relatively cool and the fact that the shrink wrap film 46 contacts the outer shroud 36 does not impede the operation or the shrinkage of the film 46 on the pizza 42 since the outer shroud 36 is not sufficiently hot to either melt or adhere to the shrink wrap film 46. As the heating of the shrink wrap film continues, the peripheral edge of the shrink wrap film 46 lifts up and contacts the bottom of the support plate 44 supporting the pizza 42 and adheres firmly thereto as the shrink wrap film 46 shrinks. After the shrinkage of the film 46 has reached a satisfactory level such that it is firmly and tightly wrapped around the pizza 42 and the support plate 44, the pizza can be lifted off of the food support disc 34 and packaged for further shipment or treatment. The heating element 18 can be left on and succeeding pizzas can be shrink wrapped in a similar fashion continuously and rapidly with the device.

The sealing unit of FIGS. 1 through 3 includes a significant advantage over the prior art which is achieved through the use of the outer shroud 36. Previously, such sealing devices included only a single shroud which contained the upwelling draft of hot air heated by the heating unit located in the device. Often the shrink wrap film draped over the food device to be sealed would come in contact with the heated single shroud and would be melted thereby thus sticking to the shroud. If the shrink wrap film adhered strongly to the shroud, the shrinkage of the film itself would then drag the food item to one side off of the disc 34, often causing the food item to collapse in a heaping mess into the interior of the inner shroud. The provision for the outer shroud 36, which remains relatively cool because of the air flow through the cylindrical air corridor 38 formed between the inner shroud 20 and the outer shroud 36, prevents the adherence of the shrink wrap film 46 to the inner shroud 20 and prevents any adherence of the shrink wrap film 46 to any other objects because the shroud 36 is relatively cool. By supporting the shroud 36 outside of and slightly higher than the inner shroud 20, any contact between the shrink wrap film 46 and the shroud 20 is prevented. In this fashion, a more reliable sealing device is created than was heretofore possible and one of the major difficulties in the use of such a device is removed.

It is to be understood that the present invention is not limited to the particular construction and arrangement of parts illustrated herein, but embraces all such modified forms thereof as come within the scope of the following claims.

I claim:

1. A sealing device for sealing a film of heat shrinkable plastic film over a pizza or other food item comprising an elevated horizontal support disc (34) to receive and support the food;

a heat source (18) located underneath the support disc (34);

an inner tubular cylindrical shroud (20) surrounding the heat source (18) and mounted beneath said support and arranged so that air may pass underneath and therethrough so that air heated by the heat source (18) generates an updraft of heated air through the inner shroud (20), said inner cylinder having a diameter not substantially larger than the horizontal dimension of the food item; and an outer tubular cylindrical shroud (36) positioned around the inner shroud (20), the diameter of the outer shroud (36) being slightly larger than that of the inner shroud (20) just sufficiently to create an air passage between them so that a food item with a horizontal dimension that is not substantially smaller than the diameter of the inner cylinder can be overlaid with a film wrap touching the outer surface of the outer cylindrical shroud so that the outer shroud stays cool so that the plastic film will not be melted when the film touches the outer shroud, the outer shroud (36) having its upper edge positioned above the upper edge of the inner shroud (20) so as to prevent any possible contact between the plastic film and the upper edge of the inner shroud (20) so that contact is prevented between a hot metal surface and the plastic film.

2. A sealing device as claimed in claim 1 wherein the outer shroud includes a plurality of inwardly extending support tabs (40) arranged to support the outer shroud on and around the inner shroud.

3. A sealing device as claimed in claim 2 wherein the support tabs (40) are formed by cut-out portions of the outer shroud.

* * * * *